United States Patent [19]

Dobberpuhl

[11] 4,062,135

[45] Dec. 13, 1977

[54] SAFE OPERATION CONTROL FOR A SNOWBLOWER

[75] Inventor: Dale Rudolph Dobberpuhl, Horicon, Wis.

[73] Assignee: Deere & Company, Moline, Ill.

[21] Appl. No.: 729,371

[22] Filed: Oct. 4, 1976

[51] Int. Cl.[2] ..... B60K 26/00; F02P 1/00

[52] U.S. Cl. ..... 37/43 R; 192/129 A; 200/157; 200/61.85; 200/61.58 R; 56/10.8; 123/198 D

[58] Field of Search ..... 37/43 R, 43 D, 43 E, 37/43 L; 192/129 R, 129 A, 130; 200/157, 61.85, 52 R, 61.58 R; 180/182 R, 103 R; 56/10.8, DIG. 15; 123/198 D, 198 DB, 198 DC

[56] References Cited

U.S. PATENT DOCUMENTS

| | | | |
|---|---|---|---|
| 3,043,028 | 7/1962 | Merry et al. | 37/43 E |
| 3,521,612 | 7/1970 | Santi et al. | 123/198 D |
| 3,580,351 | 5/1971 | Mollen | 37/43 E |
| 3,726,265 | 4/1973 | Howard | 123/198 DC X |
| 3,845,847 | 11/1974 | Camp | 123/198 DC X |
| 3,849,620 | 11/1974 | Melisz | 123/198 DC X |
| 3,881,461 | 5/1975 | Filip | 123/198 D |
| 3,942,604 | 3/1976 | Black | 200/157 X |
| 3,960,128 | 6/1976 | Anderson et al. | 123/198 DC |
| 3,964,461 | 6/1976 | Wesemeyer | 123/198 DC |
| 3,980,068 | 9/1976 | Karsten et al. | 123/198 DC |

OTHER PUBLICATIONS

"John Deere Snow Blowers" John Deere Brochure, A-55, 73-7, Aug. 14, 1973.

*Primary Examiner*—E. H. Eickholt

[57] ABSTRACT

A combined mechanical and electrical control for the traction drive and collector-impeller drive of a snowblower is provided which operates to disconnect the traction drive when the operator loosens his grip on a traction drive control lever to an extreme drive-disengage position to which it is constantly biased. Further, the control operates to stop the engine in the event that the operator loosens his grip on the level when the collector-impeller drive is engaged. However, the control is arranged such that the operator may manually hold the traction drive control lever in an intermediate drive-disengage position, while leaving the collector-impeller drive engaged without the engine stopping.

3 Claims, 6 Drawing Figures

SAFE OPERATION CONTROL FOR A SNOWBLOWER

BACKGROUND OF THE INVENTION

The present invention relates to a snowblower and more specifically relates to controls for ensuring safe operation of a snowblower.

Snowblowers include separate drives through which power is respectively transmitted from an internal combustion engine to a pair of traction wheels and to a collector-impeller. Safety standards require that a snowblower operator be in the operator's position behind the snowblower when the collector-impeller is operating and also require that the snowblower be equipped with a "deadman" control which disengages the traction drive when the operator leaves the operator's station. Such a deadman's control is known in the art.

SUMMARY OF THE INVENTION

According to the present invention there is provided a control for ensuring safe operation of a snowblower.

It is a broad object of the invention to provide a control for a snowblower which will effect snowblower operation that complies with the aforementioned safety standards.

A more specific object is to provide electrical circuitry including two switches having respective first contacts respectively formed in part by a traction drive control lever and by a collector-impeller drive control lever, the two levers respectively bearing such relationship to respective second contacts that a safety circuit containing the two switches and connected to an engine ignition systen is placed in a condition stopping the engine when the traction drive control lever is moved to an extreme drive-disengage position while the collector-impeller is in a drive-disengage position, but is maintained in a condition keeping the engine running when the traction drive control lever is moved to an intermediate drive-disengage position while the collector-impeller is in a drive disengage position.

These and other objects will become apparent from a reading of the ensuing description together with the appended drawings.

DESCRIPTION OF THE PREFERRED EMBODIMENT

Figure 1:
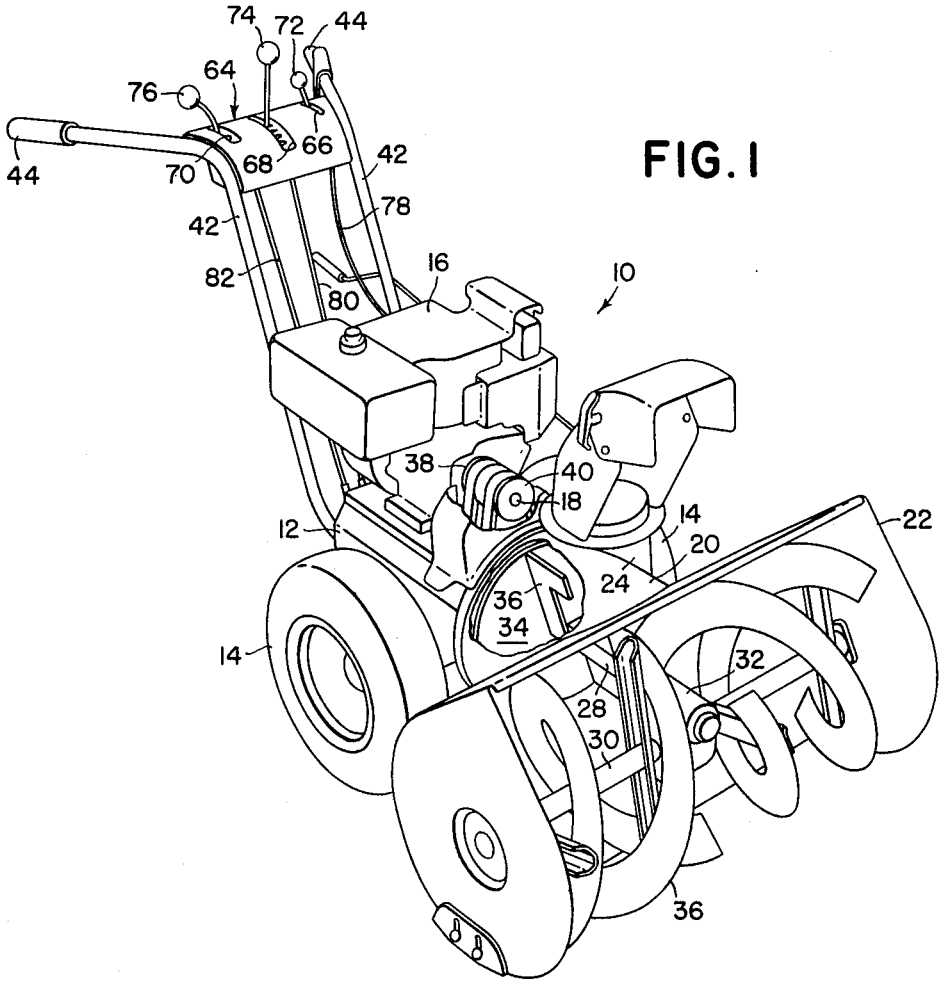
FIG. 1 is a right front perspective view of a snowblower of the type with which the present invention is particularly adapted for use.

Referring now to FIG. 1, therein is shown a walk-behind snowblower indicated in its entirety by the reference numeral 10. The snowblower 10 includes a main frame or chassis 12 supported on a pair of traction or drive wheels 14. An internal combustion engine 16 is mounted on the frame 12 between the wheels 14 and includes a forwardly projecting output shaft 18. Secured on the forward side of the frame 12 is a collector-impeller assembly including a cylindrical impeller housing 20 having an open front collector housing 22 secured to and forming an integral continuation of the front end thereof. The impeller housing 20 is provided with a tangentially extending discharge tube 24 and mounted for receiving snow blown through the tube is a discharge spout or chute 26.

Extending axially in the impeller housing 20 is a fore-and-aft impeller shaft 28 having its forward end drivingly coupled to a transverse collector shaft 30 by means gearing, not shown, located in a housing 32. An impeller 34 is mounted on the shaft 28 and includes a plurality of blades for propelling snow through the tube 24 while a spirally arranged collecting blade 36 is mounted on the shaft 30 for augering snow into contact with the impeller 34.

Mounted on the output shaft 18 of the engine 16 are a traction drive pulley 38 and a collector-impeller drive pulley 40. A first drive train (not shown) is connected between the pulley 38 and an axle having the wheels 14 mounted on opposite ends thereof while a second drive train (not shown) is connected between the pulley 40 and the impeller shaft 30. The first and second drive train may be of any conventional construction capable of being easily engaged and disengaged and for an example of such drive trains reference may be had to U.S. Pat. No. 3,580,351 issued to Mollen on May 25, 1971.

Figure 3:
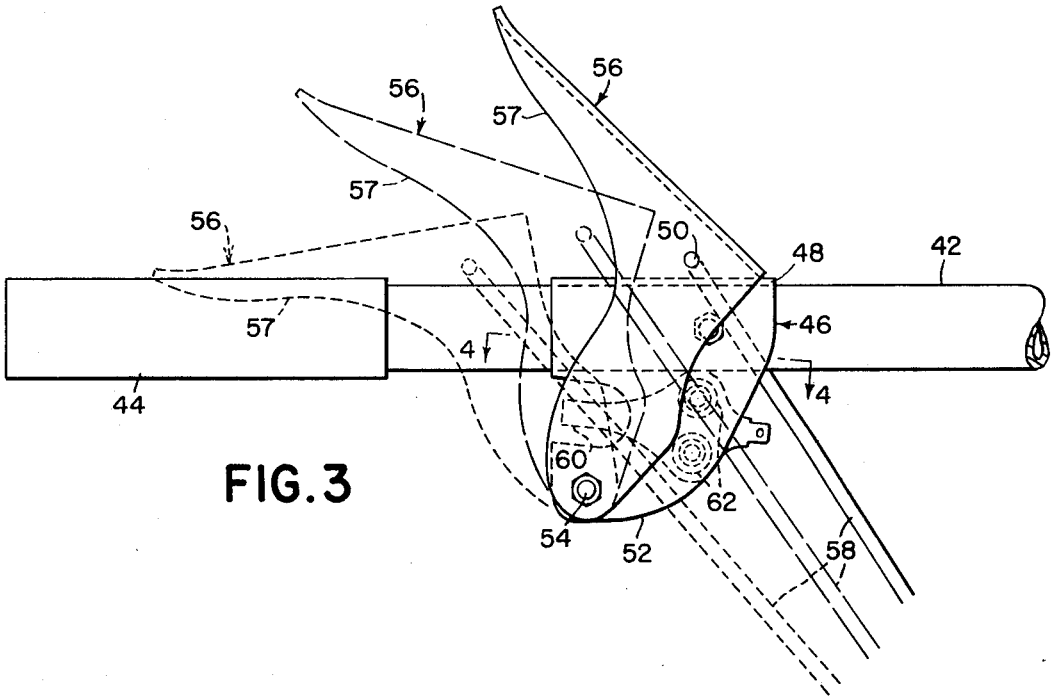
FIG. 3 is a right side elevational view of the traction drive control lever showing its relationship to a second switch contact, the lever being shown in solid lines in an extreme drive disengage position, in broken lines in an intermediate drive-disengage position and in dashed lines in a drive-engage position.
Figure 4:
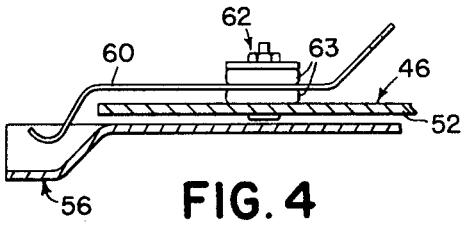
FIG. 4 is a sectional view taken along line 4—4 of FIG. 3 and showing the relationship between the lever and the switch contact when the lever is in its extreme drive-disengage position.
Figure 5:
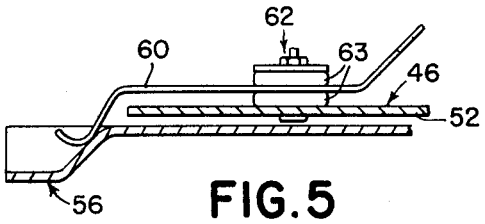
FIG. 5 is a view similar to that of FIG. 4 but showing the relationship between the lever and switch contact when the lever is in either its intermediate drive-disengage or in its drive-engage positions.

The snowblower heretofore described is controlled manually by means of a plurality of controls. Specifically, a pair of handlebars 42 have respective forward ends fixed to the frame 12 and have respective hand grips 44 at rear ends thereof. Fixed on the left handlebar 42 just forwardly of the grip 44 is a mounting bracket 46 (FIG. 3) having a portion 48 extending about the handlebar and fixed thereto by a fastener 50. The bracket 46 includes a vertical portion 52 extending downwardly from the portion 48 and pivotally secured to the portion 52, as by a horizontal pivot pin 54, is one leg of an L-shaped traction drive control lever 56 having a second leg 57 arranged to be gripped concurrently with the handgrip 44. Connected to the lever 56 and extending to a controlled element (not shown) of the traction drive is a control rod 58. In a conventional manner (not shown) the lever 56 is arranged as a deadman control in which the controlled element and hence the control rod 58 and lever 56 are biased to an extreme drive-disengage position, as shown in dashed lines in FIG. 3, wherein the lever 56 is rotated to an extreme clockwise location disposing the leg 57 away from the grip 44. The lever 56 may be manually moved counterclockwise from its extreme drive-disengage position, first to an intermediate drive-disengage position shown in broken lines in FIG. 3 and then to a drive-engage position wherein the leg 57 is disposed so as to be concurrently grasped by an operator's hand with the grip 44. Mounted on the support bracket portion 52 in a location so as to be engaged by the lever 56 only when the latter is in or is between its intermediate drive-disengaging and drive-engaging positions is a switch contact 60 having a purpose to be described hereinbelow. The contact 60 is mounted on the portion 52 by means of a pair of mounts 62, each including a pair of rubber grommets 63 sandwiching the contact and providing electrical insulation between the contact 60 and the bracket 46.

Extending between and connected to the handlbar 42 at a location forwardly of the lever 56 is a control console 64 having left, intermediate and right fore-and-aft extending guide slots 66, 68 and 70 respectively located therein and respectively receiving upwardly projecting throttle control, speed-direction control and collector-impeller drive control levers 72, 74 and 76. A flexible push-pull element 78 is connected between the lever 72 and a carburetor control arm in a conventional manner (not shown) and respective control rods 80 and 82 are respectively connected at one of their ends to the levers 74 and 76 and at their opposite ends to speed-direction and collector-impeller drive control elements (not shown). Of these three levers, only the collector-impeller drive control lever 76 is involved in the present invention and for the sake of brevity only the details of the mounting of the lever 76 is shown in detail.

Figure 2:
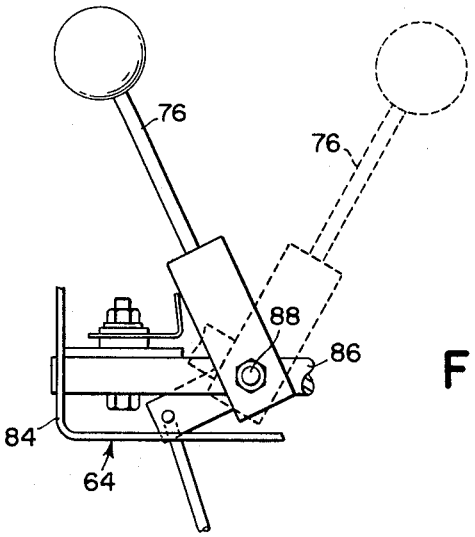
FIG. 2 is a left side elevational view, partially in section, showing the relationship between the collector-impeller drive control lever and a first switch contact, the lever being shown in solid lines in a drive-disengage position and in dashed lines in a drive-engage position.

Thus, as can best be seen in FIG. 2, the console 64 includes a bracket 84 having a fore-and-aft extending support rod 86 fixed therein. The lower end of the lever 76 is bifurcated and has opposite legs straddling the rod 86 and connected thereto by means of a pivot pin 88. A right leg of the bifurcated lower end of the lever 76 includes an angled extension 90 in which the upper end of the control rod 82 is pivotally mounted. The lever 76 is swingable fore-and-aft about the pin 88 between a forward drive-engage position and a rearward drive-disengage position, these positions being respectively shown in dashed and solid lines in FIG. 2. Mounted on the rod 86 in a location so as to be engaged by the lever 76 only when the latter is in its drive-disengage position is a switch contact 92, having a purpose to be described hereinbelow. The contact 92 is held is place by a mount 94 including a pair of rubber grommets 96 sandwiching the contact 92 and serving to electrically insulate the latter from the rod 86.

Figure 6:
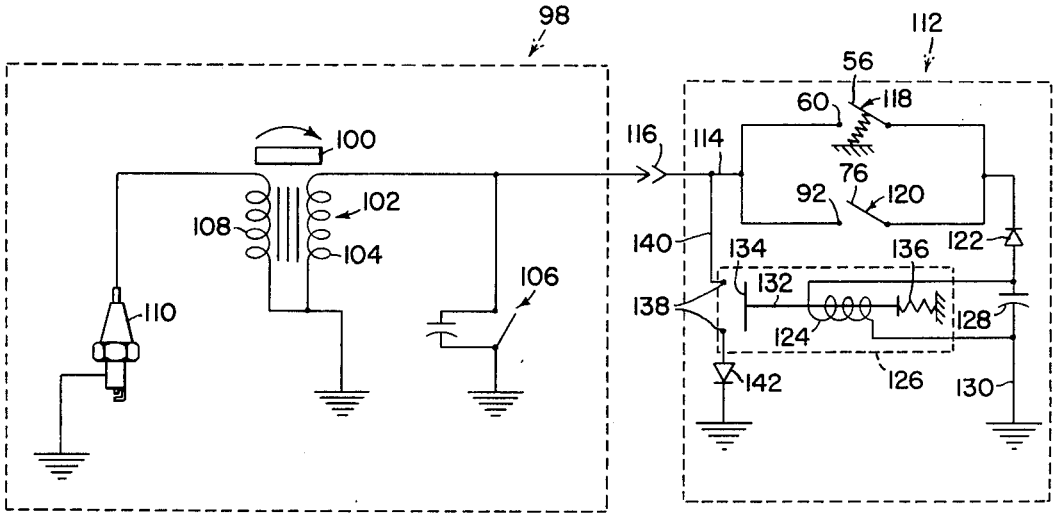
FIG. 6 is a schematic showing of the ignition system and the safety interlock electrical circuitry of the present invention.

Referring now to FIG. 6, therein is shown magneto ignition system indicated in its entirety by the reference numeral 98. The system 98 includes a fly wheel magnet 100, which rotates past a magneto coil 102 having a primary winding 104 having one side connected to a condenser-breaker point assembly 106 and having its other side connected to ground. A secondary winding 108 is positioned such that when the breaker points of the assembly 106 open the change in current in the winding 104 will induce a high voltage spike in the winding 108, the high voltage spike effecting firing of a spark plug 110 connected to one end of the winding 108. The other end of the secondary winding 108 is connected to ground. Coupled to the ignition system 98 between the primary winding 104 and the condenser-breaker point assembly 106 is a safety module or circuit 112. Specifically, the circuit 112 includes a lead 114 coupled to the system, 98 at junction 116 and coupled to a pair of switches 118 and 120 connected in parallel with each other and in series with a diode 122 and a relay coil 124 of a relay 126. A capacitor 128 is connected in parallel with the coil 124 and the circuit is completed to ground via a ground lead 130. The relay 126 includes a plunger 132 having a contact 134 at its left end which is normally biased, as by a spring 136, into engagement with a pair of contacts 138 to complete a circuit through a ground lead 140 connected to the lead 114 between the junction 116 and the switches 118 and 120 and connected to a grounded diode 142. At this point, it is notedthat the switch 118 has a first contact formed by the contact 60 and a second contact formed by the lever 56 while the switch 120 has a first contact formed by the contact 92 and a second contact formed by the lever 76.

In operation, as the flywheel magnet 100 rotates past the coil 102, a sine wave voltage pattern is formed in the primary winding 104, and at or near the peak of the positive excursion the breaker points of the assembly 106 open, and the rapid change in current in the winding 104 produces a high voltage spike in the secondary winding 108, which fires the spark plug 110. The negative voltage excursion is not used for ignition but rather is used to power the safety module or circuit 112. Thus, with the engine 16 running and the traction drive control lever 56 and the collector-impeller drive control lever 76 in their respective drive-disengage positions, the lever 56 will be out of engagement with the contact 60 while the lever 76 is in engagement with the contact 92, the switches 118 and 120 accordingly respectively being open and closed. Since the diode 122 permits current flow therethrough during the negative voltage excursion, the relay coil 124 will be energized and the plunger 132 will be in rightwardly shifted position wherein the contact 134 is separated from the contacts 138. Thus, no current will be flowing through the ground lead 140.

If the lever 76 is then moved to its drive-engage position, the switch 120 will open and the relay coil 124 will be de-energized and the spring 136 will shift the plunger 132 leftwardly to engage the contact 134 with the contacts 138 to complete a grounding path though the lead 140 and diode 142. The engine 16 will then stop.

If the operator desires that the collector-impeller drive operate while the traction drive is disengaged, he needs only to hold the lever 56 in its intermediate drive-disengage position. In this position of the lever 56, it engages the contact 60 so that switch 118 is closed. The lever 76 can then be manipulated at will to engage and disengage the collector-impeller without the engine 16 stopping since the closed switch 118 will permit current to flow to energize the relay 126 and open the ground lead 140 in the manner described above.

Thus it will be appreciated that the safety module or circuit 112 acts as an interlock which prevents the collector-impeller drive from operating when it "senses" that the operator is not in a normal operating position behind the snowblower 10 with his hand in activating contact with the traction drive control lever 56.

I claim:

1. In combination with a snowblower having a mobile frame, a handlebar assembly coupled to the frame and extending rearwardly therefrom, a collector-impeller assembly coupled to the frame and located forwardly thereof, an internal combustion engine mounted on the frame and having a magneto ignition system and an output shaft, a selectively engageable and disengageable traction drive coupled to the output shaft for propelling the frame, a traction drive control lever coupled to the traction drive and mounted on the handlebar assembly for movement between drive-disengage and drive-engage positions, a biasing means coupled to the traction drive control lever and urging it to its drive-disengage position, the collector-impeller assembly including a selectively engageable and disengageable collector-impeller drive coupled to the output shaft, and a collector-impeller drive control lever coupled to the collector-impeller drive and mounted on the handlebar assembly for movement between drive-disengage and drive-engage positions, a safety module, comprising: electrical circuit means coupled to the ignition system and including first and second switch means respectively operable in response to movement of said traction drive control lever and said collector-impeller drive control lever for effecting a condition disabling the ignition system only when the traction drive control lever is in its drive-disengage position and the collector-impeller drive control lever is in its drive-engage position.

2. The combination defined in claim 1 wherein the traction drive control lever is movable to an intermediate drive-disengage position between its drive-engage and drive-disengage positions; and said first switch means responding to the movement of the traction drive control lever so as to remain in the same condition during movement of the latter between its intermediate drive-disengage and drive-engage positions.

3. The combination defined in claim 2 wherein said first and second switch means include a pair of first contacts respectively mounted on and electrically insulated from the handlebar assembly; said pair of first contacts being respectively located adjacent the traction drive control lever and the collector-impeller drive control lever; and said traction drive control lever and said collector-impeller drive control levers respectively forming a second pair of contacts of the first and second switch means.

* * * * *